US009468308B2

(12) United States Patent
Funger

(10) Patent No.: US 9,468,308 B2
(45) Date of Patent: Oct. 18, 2016

(54) SPRINGLESS DOUBLE ENDED ELASTIC FABRIC TENSIONER

(71) Applicant: Eclips Global 2015 Incorporated, Kitchener (CA)

(72) Inventor: Edward Funger, Dundas (CA)

(73) Assignee: Eclips Global 2015 Incorporated, Kitchener (CA)

( * ) Notice: Subject to any disclaimer, the term of this patent is extended or adjusted under 35 U.S.C. 154(b) by 0 days.

(21) Appl. No.: 13/944,924

(22) Filed: Jul. 18, 2013

(65) Prior Publication Data

US 2015/0020352 A1 Jan. 22, 2015

(51) Int. Cl.
*A47C 31/11* (2006.01)
*A47C 21/02* (2006.01)

(52) U.S. Cl.
CPC ..... *A47C 31/11* (2013.01); *A47C 21/022* (2013.01); *Y10T 24/316* (2015.01)

(58) Field of Classification Search
CPC .... A47C 31/11; A47C 21/022; Y10T 24/316
USPC ..... 24/72.5, 298, 300, 301, 302, 329, 331
See application file for complete search history.

(56) References Cited

U.S. PATENT DOCUMENTS

| | | | | |
|---|---|---|---|---|
| 1,720,295 | A * | 7/1929 | Schwartzman | 24/300 |
| 2,631,803 | A * | 3/1953 | Meyers | 248/215 |
| 2,988,314 | A * | 6/1961 | Urich | 248/214 |
| 3,000,067 | A * | 9/1961 | Hanflig | 24/298 |
| 3,727,272 | A * | 4/1973 | Rhodes | 24/300 |
| 3,774,267 | A * | 11/1973 | Sneider | 24/129 B |
| 4,084,299 | A * | 4/1978 | Noda | 24/504 |
| 5,142,807 | A * | 9/1992 | Sweet | 43/4 |
| 5,377,391 | A * | 1/1995 | Foster | 24/72.5 |
| 5,867,873 | A | 2/1999 | Arend | |
| 6,149,234 | A | 11/2000 | Daniels | |
| D463,325 | S | 9/2002 | Savoia | |
| 7,243,402 | B2 | 7/2007 | Andersen et al. | |
| 7,308,739 | B2 | 12/2007 | Andersen et al. | |
| 8,342,575 | B2 * | 1/2013 | Coleman et al. | 280/818 |
| 8,863,315 | B1 * | 10/2014 | Sanders | 2/145 |
| 2007/0220717 | A1 | 9/2007 | Brinson | |
| 2012/0005867 | A1 * | 1/2012 | Whaley | 24/302 |

FOREIGN PATENT DOCUMENTS

| | | |
|---|---|---|
| CA | 138899 S | 8/2011 |

OTHER PUBLICATIONS

Tuggs Promotions, Wayback Machine Capture, Believed to be available prior to Oct. 1, 2011, 1 page.

* cited by examiner

*Primary Examiner* — Robert J Sandy
*Assistant Examiner* — Louis Mercado
(74) *Attorney, Agent, or Firm* — Nissen Patent Law; Robert Anton Nissen

(57) ABSTRACT

A springless, double ended elastic fabric tensioner including at least two gripping members, each having a first jaw and a second jaw biased together at a first pivot point and a second pivot point wherein the first and second pivot points are set apart from each other. A compression activation site is positioned in between the first and second pivot points for activating the first and second jaws from a closed position to an open position. The fabric tensioner further includes a tensioning elastomeric member having a first end and second end and providing sufficient tension between the gripping members whereby each gripping member removably engages either the first or second ends of the elastomeric member.

11 Claims, 6 Drawing Sheets

SPRINGLESS DOUBLE ENDED ELASTIC FABRIC TENSIONER

FIELD OF THE INVENTION

This invention relates in general to a clipping or gripping system nil more particularly to a double ended elastic fabric tensioner that is springless.

BACKGROUND OF THE INVENTION

Gripping systems and clipping devices have been developed, to secure or grip plastic, cloth or other sheet-type material. Typically these gripping systems have included some form of spring-clip that provides tension and securely grips the subject matter by the spring biasing and forcing the clip to a gripping position. Examples of these types of gripping systems include clothes pins, binder clips or suspenders to secure a wide variety of objects. Depending on the nature of the article being secured, and if the article is being secured to another object, gripping systems have been adapted to address a wide variety of situations. For example, gripping fabric or cloth can require different types of clipping mechanisms depending on purpose as outlined in the patents disclosed below.

U.S. Pat. No. D463,325 issued on Sep. 24, 2002 to Savoia. This patent relates to a suspender type strap that would securely hold a beach towel. The gripping mechanisms are similar to those used in suspenders where the mechanism is a spring-loaded Andersen et al, is the owner of U.S. Pat. No. 7,243,402 which issued on Jul. 17, 2007. This patent relates to a clip assembly having first and second pivoting gripping members that are locked in gripping engagement to a tarp or other material and attached to a rope or shock cord. The gripping members include jaws and arms that are joined by a pivot connection or hinge pin so that the laws are forced into engagement when the arms are pressed together. At least one of the arms is formed of a resiliently flexible material so that the arm bends a the jaws are forced to gripping engagement. There is a hook or other attachment portion on one of the arms that the arms are locked M the compressed position when a portion of the cord is passed there through. The hook may include a primary opening for receiving a bight of a rope and a secondary opening for receiving a hook on the end of a shock cord.

Andersen et al. is the owner of U.S. Pat. No. 7,308,739 which issued on Dec. 8, 2007. This patent relates to an adjustable clip for gripping a tarp or the like. There are first and second jaw portions having first ends that are joined by a hinge and second ends that are spread apart to feral a receiving area. A finger-operated screw or threaded knob is mounted to the jaw portions at a location between the first and second ends, so that the jaw portions are urged together in response to tightening of the screw or knob. The hinge may be a live hinge for resiliently biasing the jaw portions apart, and the jaw portions and live hinge may be formed as a unitarily molded structure. An attachment portion extends from the binge and has at least one opening far receiving a rope or other cord therein. The grip farce of the assembly can be adjusted by tightening or loosening the threaded knob or screw.

Daniels is the owner of U.S. Pat. No. 6,149,234 which issued on Nov. 21, 2000.This patent relates to a beach chair towel retaining system is disclosed comprising a beach towel for covering a beach chair. An upper stretchable hand resiliently surrounds both the upper portion of the towel and the upper portion of the beach chair and retains the upper portion of the to on the surface of the upper portion of the beach chair. A lower stretchable band resiliently surrounds both the lower portion of the towel and the tower portion of the beach chair and retains the lower portion of the towel on the surface of the lower portion of the beach chair. Each of the upper and lower stretchable bands comprises a bunchable towel material encasing an elastic material. A saddle bag comprising a strip with a pocket, for item storage, at each end rests on top of the intermediate portion of the towel, with one of the pockets hanging on one side of the intermediate portion of the beach chair and the other of the pockets hanging on the other side to retain the intermediate portion of the towel on the intermediate portion of the beach chair. A pillow and a pocket are detachably attached to the outer surface of the upper stretchable band.

Arend is the owner of U.S. Pat. No. 5,867,873 which issued on Feb. 9, 1999. This patent relates to a fabric securing device for securing a fabric article. The fabric securing device comprises a fabric clamp far releasably engaging a fabric article, a flexible band, and clips for releasably connecting the flexible band to the fabric clamp. One or more of the fabric securing devices can be used to secure a fabric article such as a beach towel to a structure such as a beach chair. One or more of the fabric securing devices can be used in combination with anchoring stakes to secure a fabric article such as a beach towel to a surface such as a sandy beach.

The gripping devices disclosed attempt to provide improved gripping of a fabric however those devices often require a spring type pin or hinge to provide the biasing of the jaws of the clip or grip in a closed direction. Furthermore prior art devices often require that the gripping device have a first end that grips the fabric and a second end that grips or engages another object such as a chair or other heavy object to provide tension and secure the fabric.

Thus a gripping device which efficiently grips fabric but does not require a spring or independent biasing member, does not require a supporting structure to provide the tension, provides accurate tension is desirable.

SUMMARY OF THE INVENTION

In accordance with one aspect of the present invention there is provided a springless, double ended elastic fabric tensioner including at least two gripping members, each having a first jaw and a second jaw biased together at a first pivot point and a second pivot point wherein the first and second pivot points are set apart from each other. A compression activation site is positioned in between the first and second pivot points for activating the first and second laws from a closed position to an open position. The fabric tensioner further includes a tensioning elastomeric member having a first end and second end and providing sufficient tension between the gripping members whereby each gripping member releaseably engages either the first or second ends of the elastomeric member.

Conveniently, the first jaw further includes a series of pins positioned at the first and second pivot points, and the second jaw further includes a series of pins that friction fit into corresponding cradles which engage when the compression activation sites are depressed.

Preferably, the gripping members have a first end and a second end whereby the first pivot point is positioned at the first end of the griping The member. The first and second jaws may include curve-shaped resilient walls whereby the compression activation site is positioned at a midpoint on the curve-shaped resilient walls of the first and second jaws.

In accordance with a second aspect of the invention there is provided a springless tensioner that includes at least one gripping member having a first jaw and a second jaw biased together at a first pivot point and at a second pivot point. The first and second pivot points are set apart from each other. A compression activation site is positioned in between the first and second pivot points 68 and 70 on the first and second jaws 64 and 66 for activating the first and second jaws 64 and 66 from :a closed position to an open position.

Advantages of the present invention are a tensioning device that does not require a metal spring and utilizes the structural wail of the clip and two pivot points to generate biasing force, easy to use, non-destructive to fabric it is self adhering to, does not require an additional object to hold the fabric to, and is portable.

BRIEF DESCRIPTION OF THE DRAWINGS

A detailed description of a preferred embodiment is provided herein below by way of example only and with reference to the following drawings, in which.

Figure 1:
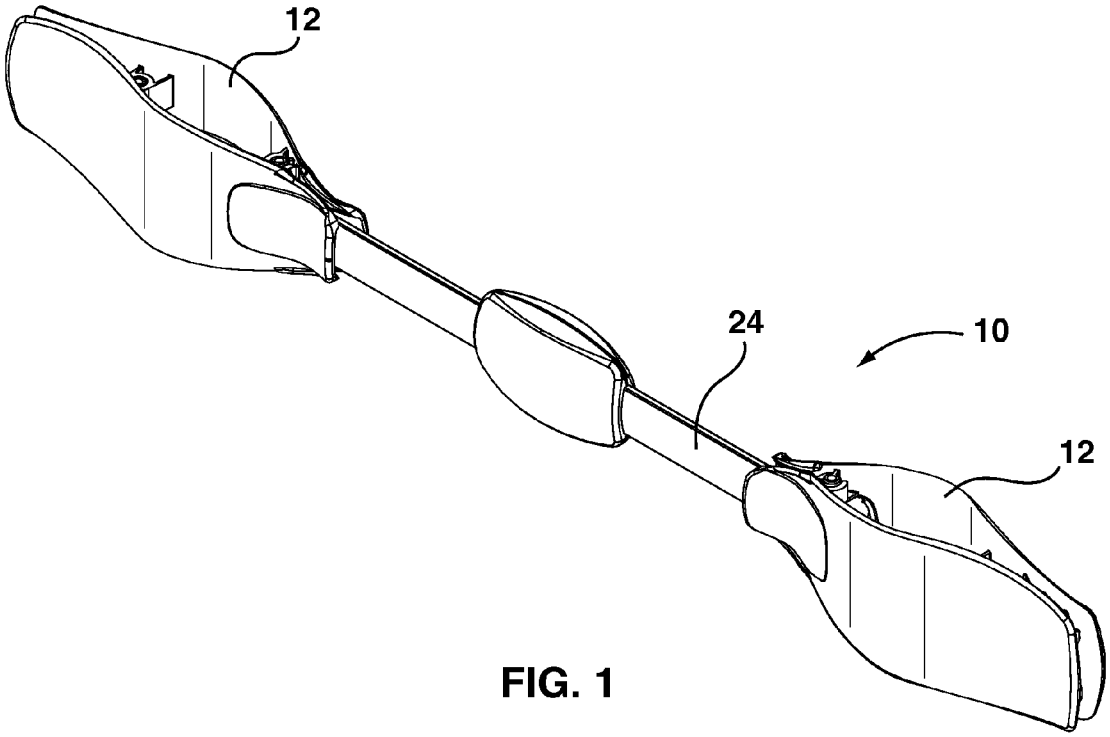
FIG. 1 in a perspective view illustrates a springless, double ended elastic fabric tensioner in accordance with the preferred embodiment of the present invention.

In the drawings, preferred embodiments of the invention are illustrated by way of example. It is to be expressly understood that the description and drawings are only far the purpose of illustration and as an aid to understanding, and are not intended as a definition of the limits of the invention.

DETAILED DESCRIPTION OF THE PREFERRED EMBODIMENT

Figure 2:
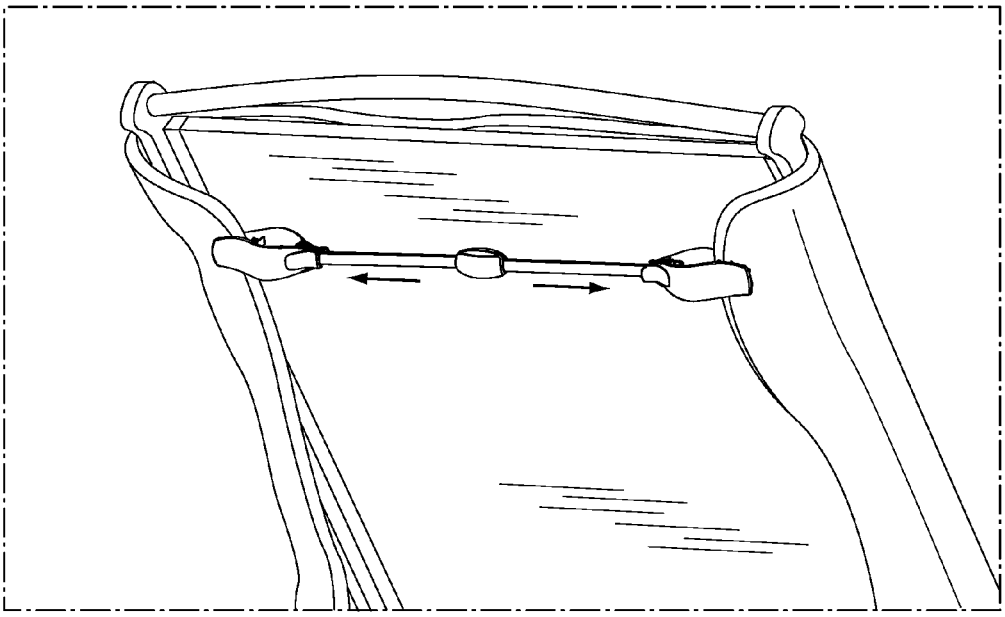
FIG. 2 in a perspective view illustrates a springless, double ended elastic fabric tensioner in operation.
Figure 5:
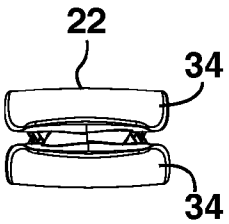
FIG. 5 in a front plan view, illustrates the springless double ended elastic fabric tensioner of FIG. 1.
Figure 3:
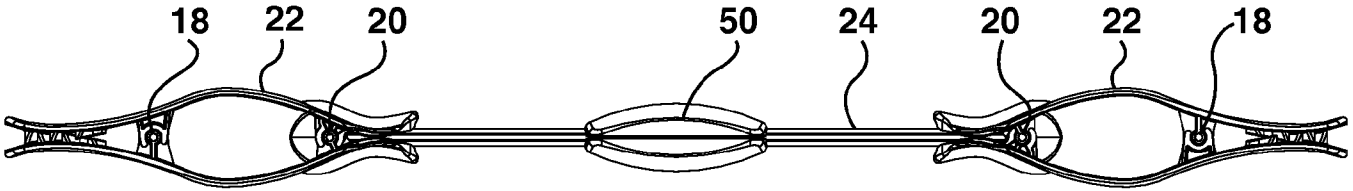
FIG. 3 in a side elevation view, illustrates the springless, double ended elastic fabric tensioner of FIG. 1.
Figure 4:
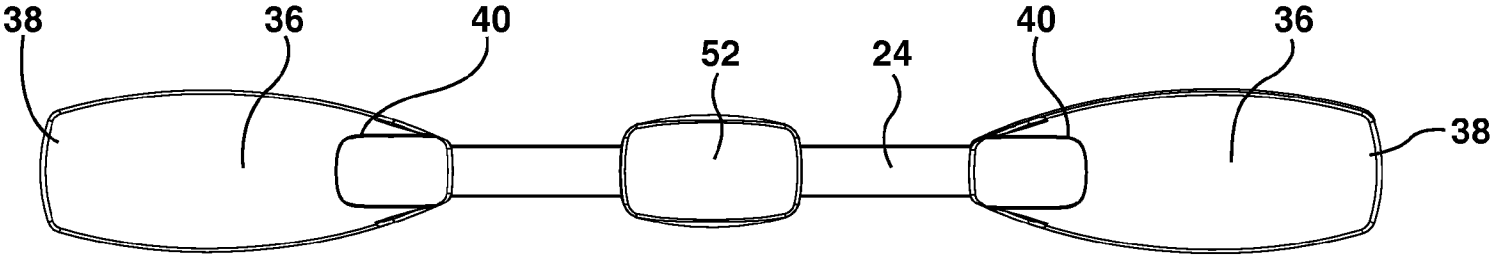
FIG. 4 in a top plan view, illustrates the springless, double ended elastic fabric tensioner of FIG. 1.
Figure 6:
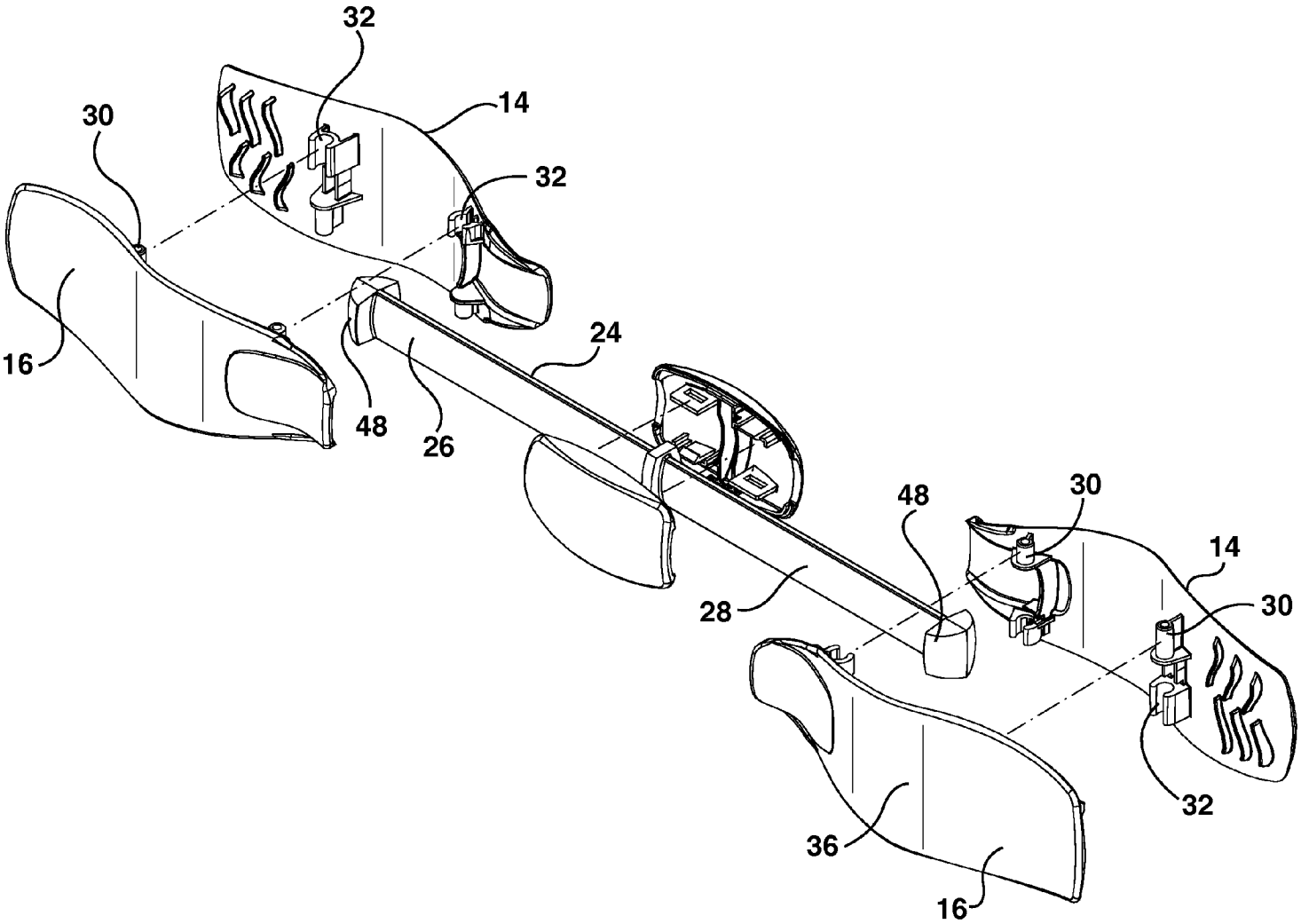
FIG. 6 in an exploded view, illustrates the springless double ended elastic fabric tensioner of FIG. 1.
Figure 7A:
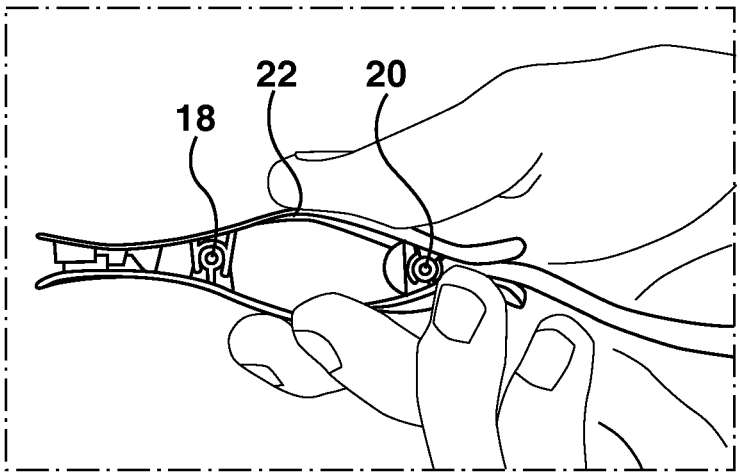
FIGS. 7*a, b c* and *d* in side views, illustrate the jaw of the springless, double ended elastic fabric tensioner of FIG. 1 in use.
Figure 7B:
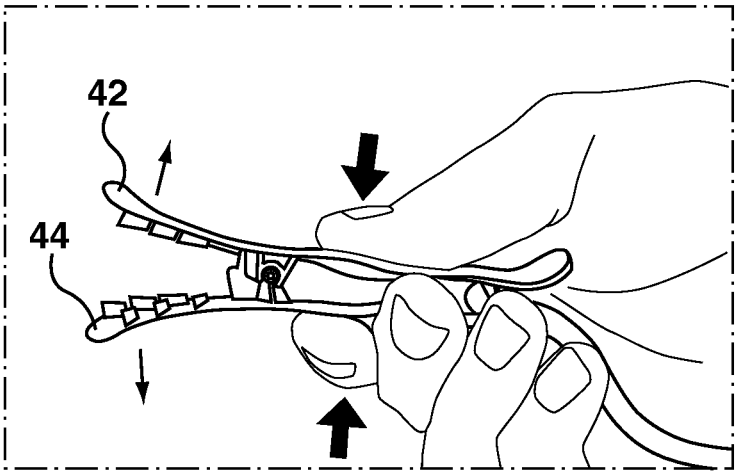
Figure 7C:
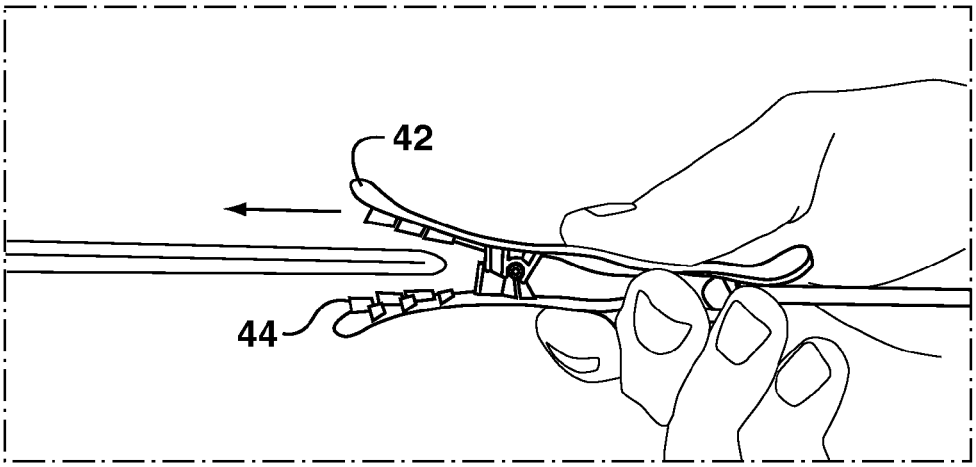
Figure 7D:
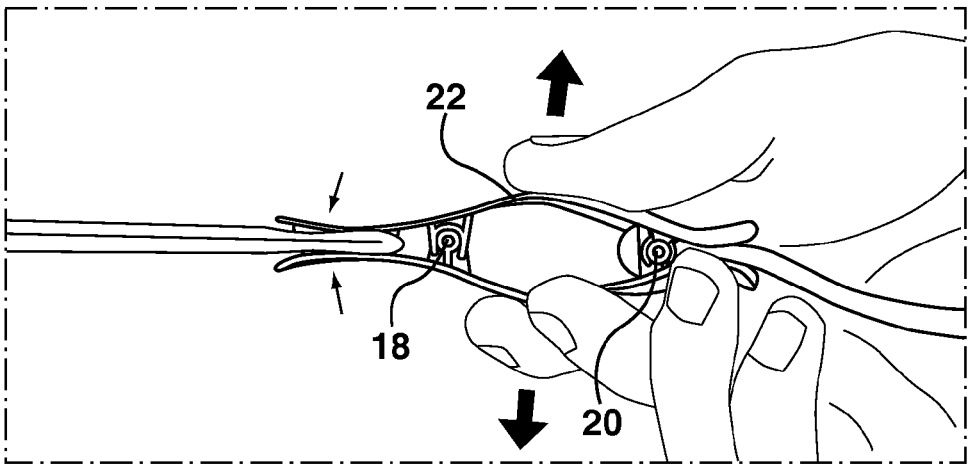
Figure 8A:
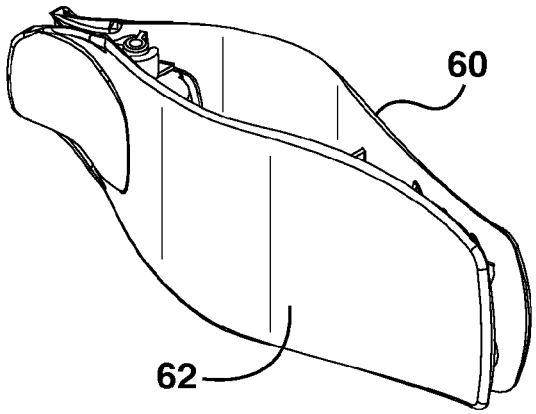
FIGS. 8*a, b* and *c* illustrate a springless tensioner in accordance with a second preferred embodiment of the invention.
Figure 8B:
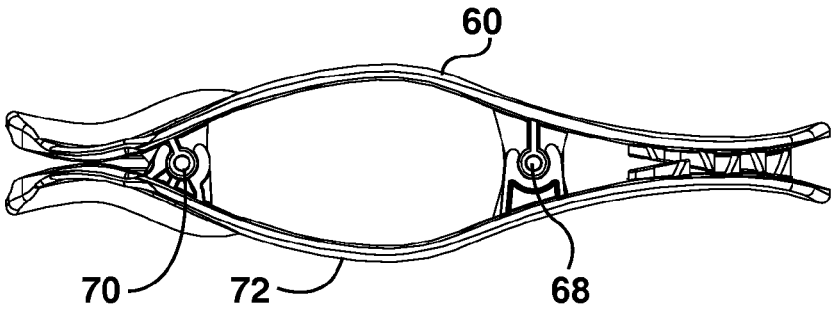
Figure 8C:
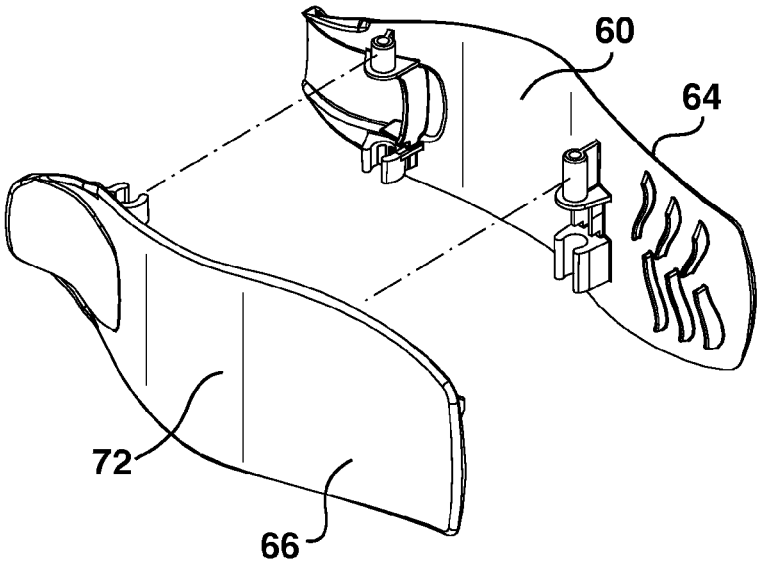

Referring to FIGS. 1 to 8*a-c*, there is illustrated a springless, double ended elastic fabric tensioner 10 in accordance with the preferred embodiment of the present invention. The springless, double ended elastic fabric tensioner 10 includes at least two gripping members 12, each gripping member 12 having a first jaw 14 and a second jaw 16 biased together at a first pivot point 18 and a second pivot point 20. The first and second pivot points 18 and 20 are set apart from each other. The gripping members 12, and specifically the first and second jaws 14 and 16, are preferably manufactured from a plastic having memory for example, but not limited to, polypro.

The first and second jaws 14 and 16 have curved-shaped resilient walls 34. The thicknesses of the walls 34 and profile of the first and second jaws 14 and 16 allow for a spring like effect. The resilient nature of the jaws is important so that the tensioner 10 does not become brittle and brake when pressure is applied. The profile of the jaws must be of sufficient thickness to withstand the weight of the fabric and provide sufficient clamping power, yet thin enough to allow a user to easily engage and have the jaws open.

A compression activation site 22 is positioned in between the first and second pivot points 18 and 20 for each jaw, which activates the first and second jaws, 14 and 16 from a closed position to an open position. The compression activation she 22 is positioned at a midpoint 36 on the curve-shaped resilient walls 34 of the first and second jaws 14 and 16. Referring to FIG. 7*a-d*, the compression activation site 22 is on the curve portion of the resilient walls 34 that extend out and provide a natural point far a user to apply pressure between the first and second pivot points 18 and 20.

The combination of the resilient nature of the jaws, the curved profile and the two pivot points 18 and 20 provides a sufficient opening to grip a fabric garment like a towel. The resilience of the gripping members 12 allows for the tensioner 10 not to crack or break when the compression activation site 22 is engaged to open the tensioner 10.

The first and second pivot points 18 and 20 each further include a series of pins 30 that friction fit into corresponding cradles 32 that actively engage when the compression activation sites 22 are depressed. Specifically the series of pins 30 may be located on the first jaw 14, and snap fit into the corresponding cradle 32 positioned on the second jaw 16. Pivot points 18 and 20 are set apart from one another along the profile of the first and second jaws 18 and 20 on either side of the compression activation site 22. Each pivot point 18 and 20 provides a fulcrum and provides the power and pressure to hold the fabric in place when the first and second jaws are in a closed position.

The fabric tensioner 10 further includes a tensioning elastomeric member 24 having a first end 26 and second end 28. Each gripping member 12 releaseably engages either the first or second ends 26 and 28 of the tensioning elastomeric member 24, thereby providing sufficient tension between the gripping members 12. The first and second ends 26 and 28 further include a stopping member 48 at each end.

The first and second jaws 14 and 16 further include a first end 38 and a second end 40 wherein the second end 40 of the jaws are releasably engaged with the tensioning elastomeric member 24. Specifically the stopping member 48 is positioned in front of the second pivot point 20 prior to the first and second jaws 14 and 16 being friction fitted together. The stopping member 48 abuts the far side of the second point and therefore the elastomeric member 24 is secured to the gripping member 12 once the pin 30 is friction fit into the corresponding cradle 32. The second end 40 of the jaws may further include a tapered end section that extends out away from the second end 40 along the elastomeric member 24.

The first end 38 of the jaws further includes a gripping end 42 having if series of teeth 44 or grooves that aid in holding the fabric secure. The teeth may be molded integrally into the first and second jaws 14 and 16. The tensioning elastomeric member 24 may also include a positioning clasp 50 located midpoint between the first and second ends 26 and 28 of the tensioning elastomeric member 24. The positioning clasp 50 may be used to adjust the length of the elastomeric member 24. The clasp may have a decorative out-facing surface 52 that can be a variety of shapes to accommodate various decorations or customizations. The tensioning elastomeric member 10 may be made from elastomeric material having a Durometer range of 5-50 and can include different shapes for additional decoration and customization.

In operation the first gripping member 12 is grasped by a user who applies pressure to the compression activation site 22. The application of pressure forces the gripping end 42 at the first end 38 of the jaws 14 and 16 to an open position. Specifically the two pivot points 18 and 20 allow for the movement to the open position. The user may then insert to opening between the jaws the fabric such as a towel or whatever the user wishes to grasp. The release of the pressure causes the jaws 14 and 16 to move back to a closed position without the use of a spring and the gripping end 42 grasps the fabric in a secure manner.

The fabric may be a towel by way of example only that is positioned over a chair back. The first gripping member 12 is secured to the edge of the towel and the second gripping member 12 may be engaged to grip the other edge of the towel across the chair back. The elastomeric member 24 engages and stretches in between the two gripping members 12 thereby providing tension between the two gripping members 12. The tensioner 10 therefore securely holds the towel to the chair back and there is no danger of the towel or other fabric from blowing away. The positioning of the tensioner 10 relative to the towel or fabric can be utilized in a number of environments such as the beach, cruise ships or where ever a piece of fabric and support for the fabric require additional securement.

The resilient material of the jaws 14 and 16 coupled with the two pivot points 18 and 20 allows for the tensioner 10 to be biased in a closed position securely grasping the fabric without the use of a traditional spring to bias the jaws 14 and 16 in a closed position. The use of two pivot points 18 and 20 which act as fulcrums allows the tensioner 10 to be springless. The tensioner 10 does not require additional parts and allows for the jaws 14 and 16 to be one piece and friction fitted together around the tensioning elastomeric member 24. The jaws 14 and 16 may be molded in one piece from the preferred resilient plastic.

In an alternative embodiment there is provided a springless tensioner 60 that includes at least one gripping member 62 having a first jaw 64 and a second jaw 66 biased together at a first pivot point 68 and at a second pivot point 70. The first and second pivot points 68 and 70 are set apart from each other. A compression activation site 72 is positioned in between the first and second pivot points 68 and 70 on the first and second jaws 64 and 66 for activating the first and second jaws 64 and 66 from a closed position to an open position. The springless tensioner 60 is identical in structure to the gripping member 12 described above.

The springless tensioner 60 may be used in a variety of ways that require the pressure, power and strong clipping action provided by the gripping member 62, namely, paper clip, photo clip jumper cable, money clip, cable tie, clothes pin, pant hangers, hair clip and curtain clip by way of example only.

Other variations and modifications of the invention are possible. All such modifications or variations are believed to be within the sphere and scope of the invention as defined by the claims appended hereto.

I claim:

1. A double ended elastic fabric tensioner comprising:

(a) at least two gripping members, each gripping member having a first jaw and a second jaw, the first jaw and the second jaw each having a first jaw end and a second jaw end opposed to the first jaw end, the first jaw and second jaw being biased together at a first pivot point and at a second pivot point wherein the first and second pivot points are set apart from each other;

(b) a compression activation site positioned in between the first and second pivot points on the first and second jaws for activating the first and second jaws from a closed position to an open position; and (c) a tensioning elastomeric member having a first end and second end wherein each end has a stopping member enclosed within a respective gripping member, with the stopping member extended between the first jaw and the second jaw at the second jaw ends and toward the first jaw ends to cross the second pivot point and abut first jaw end facing surfaces of either or both the first jaw and the second jaw;

whereby each gripping member engages either the first end or the second end of the tensioning elastomeric member to provide tension between the gripping members when the gripping members are stretched apart in the open or closed position, in which each second pivot point comprises a pair of pivot points set apart along a pivot axis, with the tensioning elastomeric member passing between the pair of pivot points.

2. The double ended elastic fabric tensioner as claimed in claim 1 wherein each of the first and second pivot points further comprises pins and corresponding cradles that friction fit together and whose axes are coaxial with a respective pivot axis defined by the first pivot point or second pivot point.

3. The double ended elastic fabric tensioner as claimed in claim 2 wherein the first and second jaws further comprise curved-shaped resilient walls.

4. The double ended elastic fabric tensioner as claimed in claim 3 wherein the compression activation site is positioned at a midpoint on the curve-shaped resilient walls of the first and second jaws.

5. The double ended elastic fabric tensioner as claimed in claim 2 in which each of the first pivot point and the second pivot point comprise a first pin and first cradle on the first jaw, and a second pin and a second cradle on the second jaw, with the first pin fitted into the second cradle, and the second pin fitted into the first cradle.

6. The double ended elastic fabric tensioner as claimed in claim 1 wherein the first jaw ends of the first jaw and the second jaw further includes a gripping end having a series of teeth.

7. The double ended elastic fabric tensioner as claimed in claim 6 wherein the teeth are rubber.

8. The double ended elastic fabric tensioner as claimed in claim 7 wherein the tensioning elastomeric member further comprises a positioning clasp located midpoint between the first and second ends of the tensioning elastomeric member.

9. The double ended elastic fabric tensioner as claimed in claim 1 wherein the tensioning elastomeric member is made from elastomeric material having a Durometer range of 5-50.

10. The double ended elastic fabric tensioner as claimed in claim 1 in which each stopping member widens with decreasing distance from the respective first end or second end of the tensioning elastomeric member.

11. A method of assembling the double ended elastic fabric tensioner as claimed in claim 1 comprising, for each gripping member, connecting the first jaw and the second jaw together at the first pivot point and the second pivot point to enclose the respective stopping member within the gripping member.

* * * * *